US009663898B2

(12) United States Patent
Zhang

(10) Patent No.: US 9,663,898 B2
(45) Date of Patent: May 30, 2017

(54) AUTOMATIC MULTI-STATION INTEGRATED EQUIPMENT AND METHOD FOR FORMING WASTE-PAPER-BASED PACKAGING PRODUCTS

(71) Applicant: Paul Zhang, Wenatchee, WA (US)

(72) Inventor: Paul Zhang, Wenatchee, WA (US)

( * ) Notice: Subject to any disclaimer, the term of this patent is extended or adjusted under 35 U.S.C. 154(b) by 0 days.

(21) Appl. No.: 14/786,317

(22) PCT Filed: Feb. 26, 2014

(86) PCT No.: PCT/US2014/018784

§ 371 (c)(1),
(2) Date: Oct. 22, 2015

(87) PCT Pub. No.: WO2014/193504

PCT Pub. Date: Dec. 4, 2014

(65) Prior Publication Data

US 2016/0090694 A1 Mar. 31, 2016

(30) Foreign Application Priority Data

May 9, 2013 (CN) ..... 2013 1 0177726
May 9, 2013 (CN) ..... 2013 1 0177729
(Continued)

(51) Int. Cl.
*D21J 3/00* (2006.01)
*D21J 3/10* (2006.01)
(Continued)

(52) U.S. Cl.
CPC ..... *D21F 9/04* (2013.01); *D21J 3/00* (2013.01); *D21J 3/10* (2013.01); *D21J 7/00* (2013.01)

(58) Field of Classification Search
CPC ..... D21J 3/00; D21J 3/10; D21J 7/00; D21F 9/04
(Continued)

(56) References Cited

U.S. PATENT DOCUMENTS 2,967,568 A * 1/1961 Friday ..... D21J 7/00 162/382
3,957,558 A * 5/1976 Lee ..... B29C 51/16 156/212
(Continued)

FOREIGN PATENT DOCUMENTS

CN 102995502 A 3/2013
KR 20130078442 A * 7/2013
(Continued)

OTHER PUBLICATIONS

EPO Machine Translation of CN-102995502 A, Published on Mar. 27, 2013.*

*Primary Examiner* — Jose Fortuna
(74) *Attorney, Agent, or Firm* — Lance M. Pritikin

(57) ABSTRACT

Disclosed are embodiments of an automatic multi-station integrated equipment for forming waste-paper-based-pulp packaging products, and related methods of operation. The equipment comprises at least one suction filter forming station integrated with one or more pair of high-temperature drying stations. The suction filter forming station includes a forming frame, pulp tank, forming plate apparatus, transfer plate apparatus, transfer air storage tank, horizontal transfer air cylinder, vertical transfer air cylinder, forming hydraulic cylinder, and forming apparatus main shaft. Each high-temperature drying station may include an upper press plate apparatus, lower press plate apparatus, high pressure air cylinder, lower horizontal air cylinder, air storage tank and upper horizontal air cylinder. Embodiments of the invention generally use one suction filtration forming station in con-
(Continued)

junction with multiple high temperature drying stations to form a single production line.

8 Claims, 6 Drawing Sheets

(30) Foreign Application Priority Data

May 9, 2013 (CN) ..... 2013 2 0262770 U
May 9, 2013 (CN) ..... 2013 2 0262871 U

(51) Int. Cl.
*D21J 7/00* (2006.01)
*D21F 9/04* (2006.01)

(58) Field of Classification Search
USPC ..... 162/218, 224, 225, 382, 387–391, 407, 162/410–411
See application file for complete search history.

(56) References Cited

U.S. PATENT DOCUMENTS 5,531,864 A * 7/1996 Miyamoto ..... D21J 7/00 162/199
5,785,817 A * 7/1998 Tan ..... C08J 9/32 162/218
5,900,119 A * 5/1999 Goers ..... B65D 81/09 162/218
6,245,199 B1 * 6/2001 Lee ..... D21J 7/00 162/382
6,287,428 B1 * 9/2001 Gale ..... D21J 7/00 162/382
6,332,956 B1 * 12/2001 Lee ..... D21J 3/00 162/378
6,352,617 B1 * 3/2002 Lee ..... D21J 7/00 162/218
6,582,562 B2 * 6/2003 Gale ..... D21J 7/00 162/226
6,605,187 B1 * 8/2003 Nonomura ..... D21J 7/00 162/224
6,716,319 B2 * 4/2004 Gale ..... D21J 7/00 162/218
7,591,927 B2 * 9/2009 Kim ..... B31D 5/02 162/147
8,795,474 B2 * 8/2014 Lang ..... D21J 3/00 162/382
2003/0136537 A1 7/2003 Frederiksen et al.
2013/0228301 A1 * 9/2013 Lang ..... D21J 3/00 162/231
2016/0090694 A1 * 3/2016 Zhang ..... D21F 9/04 162/217

FOREIGN PATENT DOCUMENTS

WO 2005012640 A1 2/2005
WO WO 2014193504 A1 * 12/2014 ..... D21J 3/00

* cited by examiner

AUTOMATIC MULTI-STATION INTEGRATED EQUIPMENT AND METHOD FOR FORMING WASTE-PAPER-BASED PACKAGING PRODUCTS

RELATED APPLICATIONS

This application is a U.S. National Phase under 35 U.S.C. §371 of International Application No. PCT/US2014/018784, filed Feb. 26, 2014, which in turn claims the benefit of Chinese Utility Model Application No. 201320262770.4, filed May 9, 2013, Chinese Patent Application No. 201310177729.1, filed May 9, 2013, Chinese Utility Model Application No. 201320262871.1, filed May 9, 2013, and Chinese Patent Application No. 201310177726.8, filed May 9, 2013, the contents of each of which are incorporated by this reference in their entirety for all purposes as if fully set forth herein.

TECHNICAL FIELD

The present invention relates generally to the manufacturing of packaging products from waste-paper-based pulp. More particularly, the invention relates to automatic multi-station integrated equipment and methods for manufacturing waste-paper-based packaging products.

BACKGROUND

Traditional automatic pulp forming technology may typically consist of one suction filter forming station and one high temperature drying station. The completion of one forming cycle of a suction filter forming station may be less than 5 seconds, but the drying time is typically substantially longer. Consequently, traditional suction filter forming station may be idle for more than half of the time of the forming process. At least one operator is required per machine per shift, resulting in low unit output per labor demands. Prior expedients have been proposed which combine multiple drying stations with a single forming station. However, improvements in the construction and operation of such equipment are needed in order to optimize their efficiency and reliability.

SUMMARY

Certain deficiencies of the prior art may be overcome by the provision of automatic multi-station integrated equipment and methods for manufacturing waste-paper-based packaging products as described and claimed herein. In addition to the waste paper, the equipment and methods described herein can also use cardboard to manufacture packaging according to customer's requirement, satisfying demands of a broad market range.

An exemplary automatic multi-station integrated equipment for forming waste-paper-based packaging products may comprise a suction filter forming station and at least one pair of high-temperature drying stations. The suction filter forming station may include a forming frame, a pulp tank, a forming plate apparatus, a forming apparatus main shaft, and a respective transfer plate apparatus corresponding to each pair of high-temperature drying stations. The forming apparatus main shaft may be rotatably mounted with respect to said forming frame. Each transfer plate apparatus may have a forming/transfer air supply, a horizontal transfer air cylinder, and a vertical transfer air cylinder. The pulp tank may be fixed within the forming frame, for example, by being attached to the frame itself or retained in a position substantially stationary with respect to the frame.

A top of the forming plate apparatus may be fitted with one or more forming molds. A bottom of the forming plate apparatus may be connected to an upper side of the forming apparatus main shaft and rotatable therewith. The forming apparatus main shaft may be equipped with a toothed gear. A toothed rack may be provided which meets with the toothed gear of the forming apparatus main shaft. The toothed rack may be configured to be linearly actuated while in engagement with the toothed gear so as to cause the shaft to reciprocally turn over or "flip" the forming plate apparatus (typically approximately 180 degrees). This allows the forming molds to be quickly and efficiently dipped into the wet pulp within the pulp tank directly below the forming plate apparatus, then repositioned upward for further processing of the captured layer of wet pulp material.

The vertical transfer air cylinder may be connected between a transfer support plate and the transfer plate apparatus. One or more transfer molds may be installed on the transfer plate apparatus. The transfer plate apparatus may be movable in a vertical motion by, for example, the vertical transfer air cylinder and guided by, for example, one or more plate guide shafts.

Each pair of high-temperature drying stations is typically matched with the single suction filter forming station. For example, certain embodiments may feature a single pair of (i.e., two) high-temperature drying stations matched with the suction filter forming station, and other embodiments may include two pair of (i.e., four) high-temperature drying stations matched with the one suction filter forming station.

Each one of the high-temperature drying stations typically comprises an upper press plate apparatus, a lower press plate apparatus, a lower horizontal air cylinder, a high pressure air cylinder, an upper horizontal air cylinder, and a pressing air supply. Each upper press plate apparatus may be equipped with one or more upper press molds. The high pressure air cylinders being fixed on respective press support plates. The upper press plate apparatuses may be drivable by their respective high pressure air cylinders and may be guided by, for example, one or more press plate guide shafts. Each lower press plate apparatus is typically equipped with one or more lower press molds. Each lower horizontal air cylinder may be installed on a respective pressing frame and configured to drive a left/right (e.g., lateral) movement of its respective lower press plate apparatus.

Each transfer support plate of the suction filter forming station may be set on one or more horizontal transfer guide tracks which are secured to inner crossbeams of, for example, the forming frame. Similarly, each press support plate may be set on horizontal guide tracks over a respective high temperature drying station.

Also described herein are methods for forming waste-paper-based packaging products by way of, for example, embodiments of the described automatic multi-station integrated equipment.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
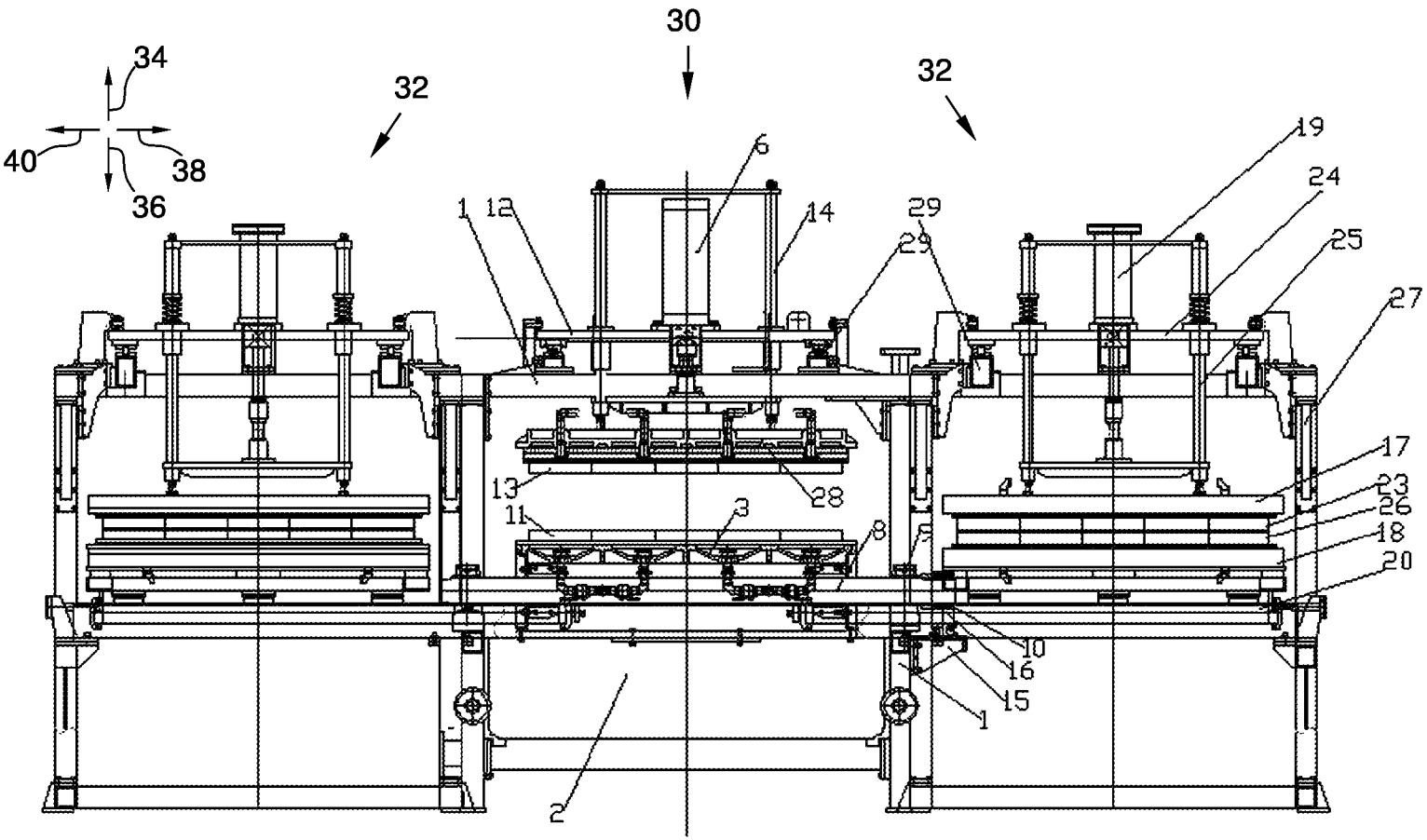
FIG. 1 is a diagrammatic front view of equipment for manufacturing waste-paper-based packaging products in accordance with one non-limiting embodiment of the present invention.

Referring now to the drawings, like reference numerals designate identical or corresponding features throughout the several views.

The general purpose of the invention is to overcome the defects and insufficiencies of the existing technology, using, for example, automatic PLC control, one or more design programs, concise product stacking, a recycling system, design of maximum production capacity templates, and to provide a fully automatic multi-station integrated equipment for forming packaging products from waste-paper-based pulp. In addition to the waste paper, cardboard can also be used to manufacture packaging according to a particular customer requirement, embodiments of the invention therefore satisfying demands of a broad market range.

Embodiments of the present invention may provide a number of advantages over existing technology, including one or more of the following: (i) improved machine efficiency—using one suction filter forming station integrated with multiple high temperature drying stations to make a single production line; (ii) simplified and improved efficiency of suction system—may use individual vacuum pumps instead of large suction system; (iii) significant reduction of raw material usage—weight of product from present invention may be only 75-80% of product from existing technology; (iv) improved stability of product quality—improved smoothness and lighter weight (The suction filter forming station of present invention may have a continuous workload; Similarly, pulp may be supplied continuously resulting in improved pulp stability and product quality); and (v) improved labor efficiency—traditional single station pulp molding machinery typically requires one worker for each output station, whereas the present invention typically needs only one worker for multiple output stations.

Figure 2:
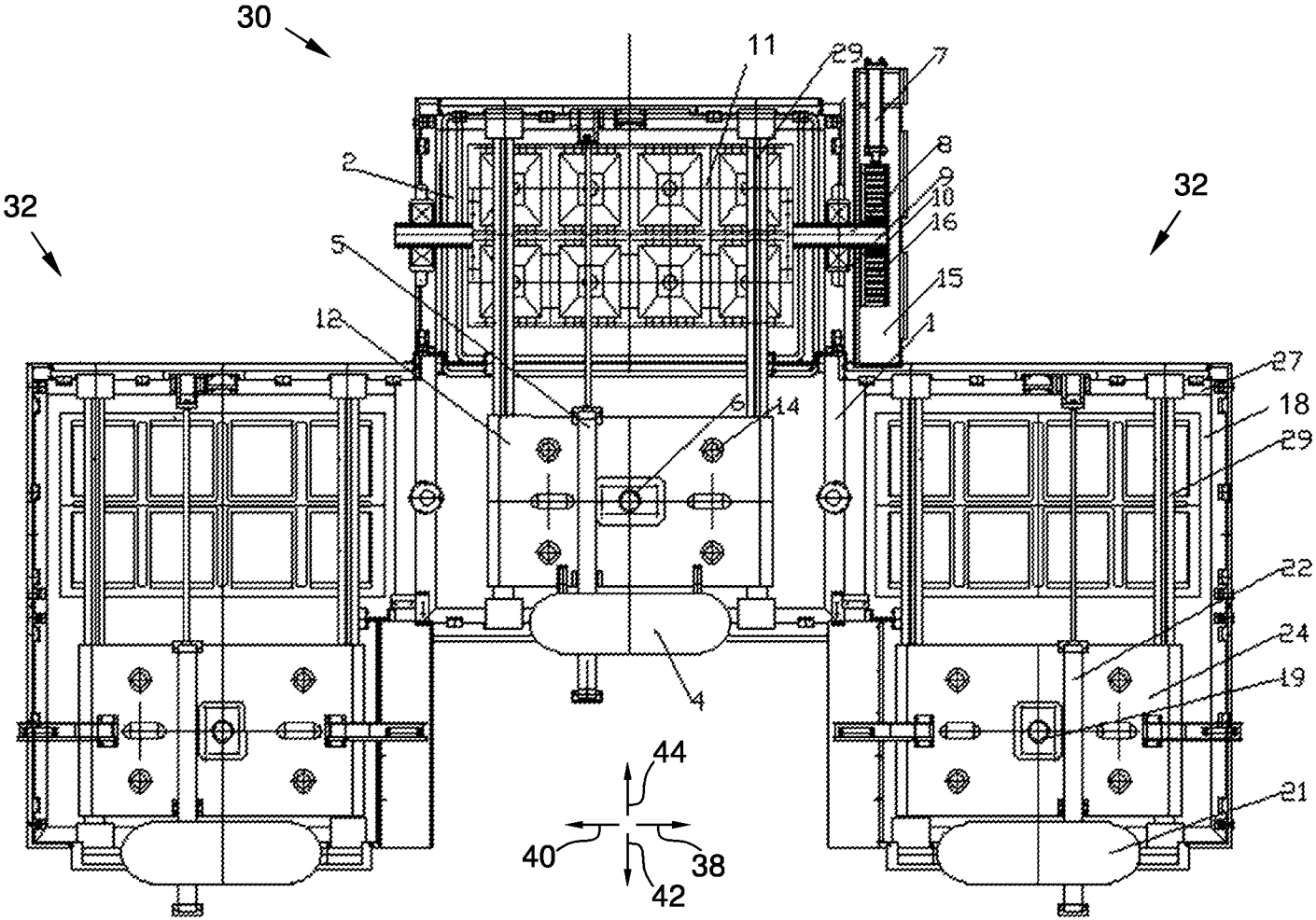
FIG. 2 is a diagrammatic top view of the equipment shown in FIG. 1, wherein one pair of high temperature drying stations is shown matched with a single filter forming station.

Automatic Multi-Station Integrated Equipment for Forming Waste-Paper-Based Packaging Products Referring to FIGS. 1 and 2, embodiments of an automatic multi-station integrated equipment for forming waste-paper-based packaging products generally comprise a suction filter forming station (30) and at least one pair of high-temperature drying stations (32). The suction filter forming station (30) may include a forming frame (1), a pulp tank (2), a forming plate apparatus (3), a forming apparatus main shaft (8), and a respective transfer plate apparatus (28) corresponding to each pair of high-temperature drying stations. The forming apparatus main shaft (8) may be rotatably mounted with respect to the forming frame (1). Each transfer plate apparatus (28) may have a forming/transfer air supply, a horizontal transfer air cylinder (5), and a vertical transfer air cylinder (6). The pulp tank (2) may preferably be fixed within the forming frame (1), for example, by being attached to the frame itself or retained in a position substantially stationary with respect to the frame. In certain such embodiments, the tank (2) may be a structure separate from the forming frame (1), wherein each structure is secured to the same floor surface frictionally, by way of fasteners, a combination thereof, or the like.

A top of the forming plate apparatus (3) is fitted with one or more forming molds (11). A bottom of the forming plate apparatus (3) my preferably be connected to an upper side of the forming apparatus main shaft (8) and rotatable therewith. The forming apparatus main shaft (8) may be equipped with, for example, a toothed gear (10). A toothed rack (16) may typically meet with the toothed gear (10) of the forming apparatus main shaft (8). The toothed rack (16) is preferably configured to be linearly actuated while in geared engagement with the toothed gear (10) so as to cause the forming apparatus main shaft (8) to reciprocally turn over the forming plate apparatus (3).

Referring to FIG. 1, each vertical transfer air cylinder (6) may be connectedly disposed between a respective transfer support plate (12) and transfer plate apparatus (28). One or more transfer molds (13) may be installed on each transfer plate apparatus (28). Each transfer plate apparatus (28) may be movable in a vertical motion (e.g., upward (34) and downward (36)) by, for example, the vertical transfer air cylinder (6), and guided by, for example, one or more plate guide shafts (14).

Figure 3:
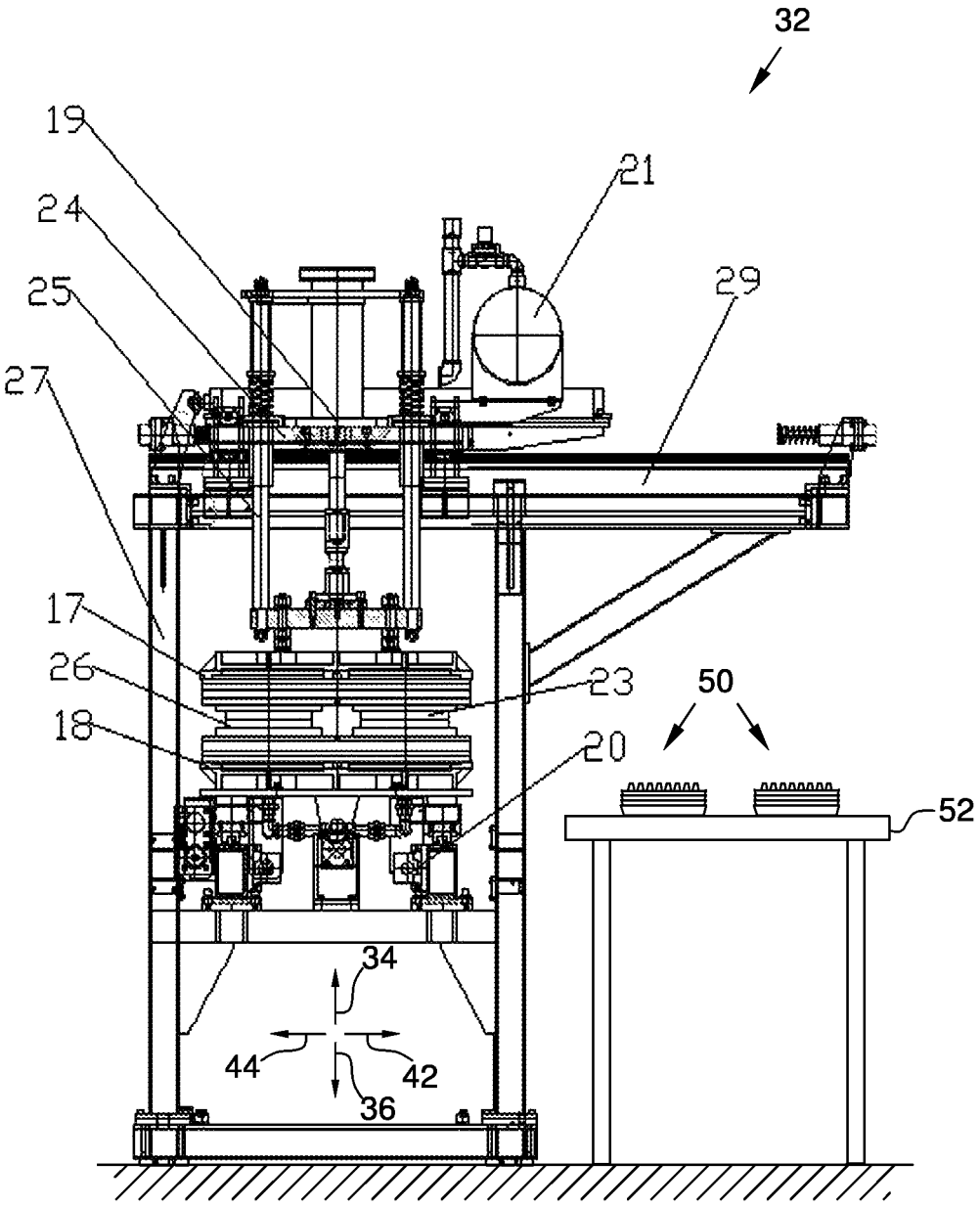
FIG. 3 is a diagrammatic side view of one non-limiting embodiment of a single high-temperature drying station, shown with a product support platform for supporting a growing stack of dried product received from the upper press plate apparatus of the high-temperature drying station.

Referring to FIGS. 1-3, each pair of high-temperature drying stations (32) is typically matched with the suction filter forming station (30). Each one of the high-temperature drying stations (32) may comprise an upper press plate apparatus (17), a lower press plate apparatus (18), a lower horizontal air cylinder (20), a high pressure air cylinder (19), an upper horizontal air cylinder (22), and a pressing air supply. Further, the temperature may be operator-adjustable independently for each transfer plate apparatus (28), upper press plate apparatus (17) and lower press plate apparatus (18). In particular preferred embodiments, such temperatures may be set up to approximately 290 degrees C.

Referring to FIG. 3, each upper press plate apparatus (17) may be equipped with one or more upper press molds (23). Each high pressure air cylinder (19) being fixed on a press support plate (24). The upper press plate apparatus (17) may be drivable in an upward direction (34) and downward direction (36) by its respective high pressure air cylinder (19) and guided by one or more press plate guide shafts (25).

Referring again to FIG. 3, each lower press plate apparatus (18) is typically equipped with one or more lower press molds (26). Each lower horizontal air cylinder (20) may be installed on a respective pressing frame (27) and configured to drive a left/right (e.g., lateral) movement of its respective lower press plate apparatus (18).

As illustrated, for example, in FIG. 1, each transfer support plate (12) of the suction filter forming station (30) may preferably be set on one or more horizontal transfer guide tracks (29) which may be secured to inner crossbeams of the forming frame (1). Similarly, each press support plate (24) may be set on horizontal guide tracks (29) over a respective high temperature drying station (32).

Referring to FIG. 2, in particular embodiments of an automatic multi-station integrated equipment for forming waste-paper-based packaging products, the suction filter forming station (30) may include a forming hydraulic cylinder (7) configured to perform the linear actuation of the toothed rack (16).

Referring to FIG. 2, in certain embodiments of equipment in accordance with the present invention, each forming/transfer air supply may be a forming/transfer air storage tank (4). Similarly, each pressing air supply may be a pressing air storage tank (21). In particular such embodiments, each forming/transfer air storage tank (4) and horizontal transfer air cylinder (5) may be mounted on its respective transfer support plate (12), and/or each pressing air storage tank (21) and upper horizontal air cylinder (22) may be fixed to a respective press support plate (24).

Figure 4:
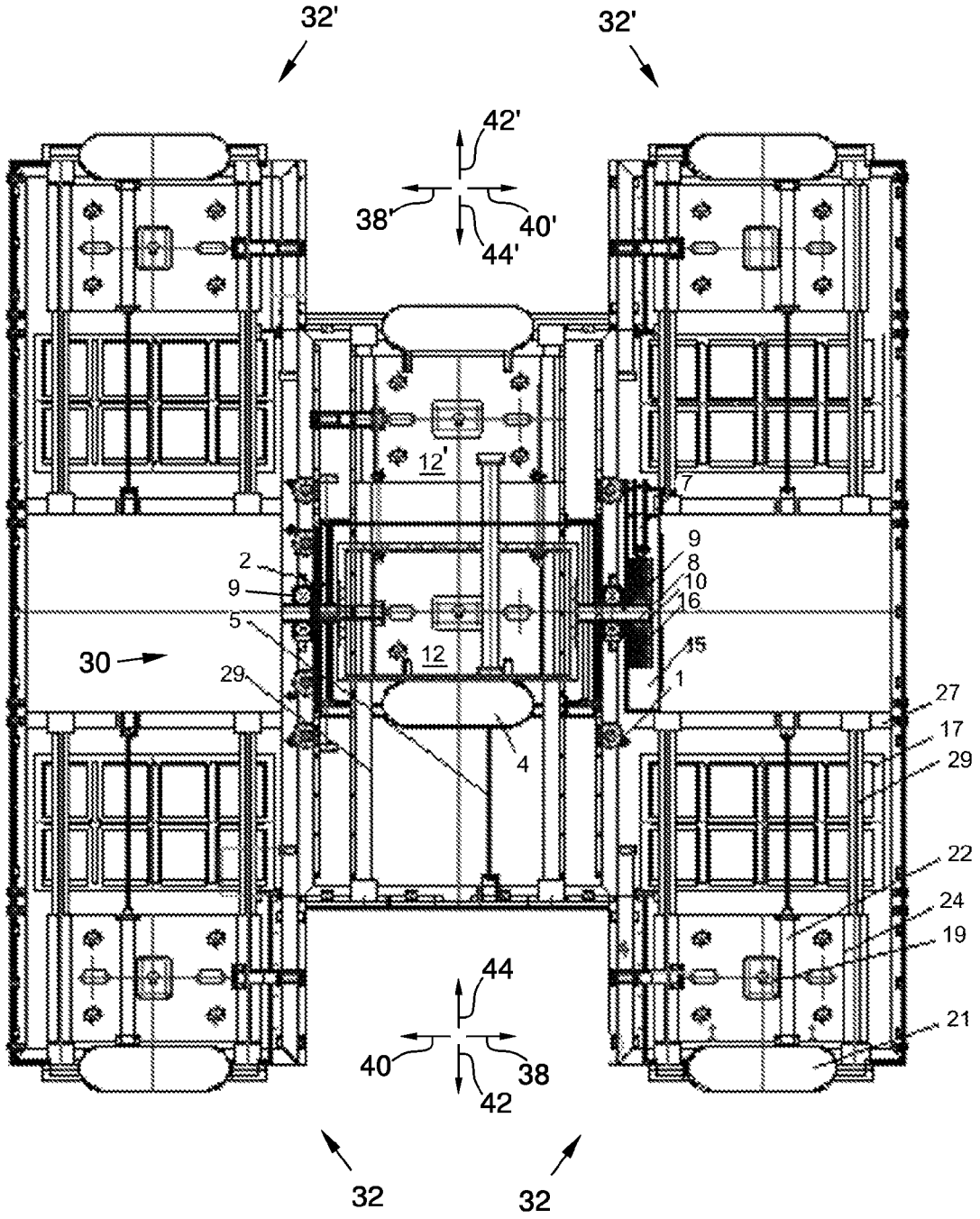
FIG. 4 is a diagrammatic top view of equipment similar to that of FIG. 2, but wherein two pair of high temperature drying stations are matched with the single filter forming station, the lower press plate apparatuses of each pair of high temperature drying stations interacting with a respective transfer plate apparatus.

Referring to FIGS. 2 and 4, in particular embodiments of equipment in accordance with the present invention, the forming apparatus main shaft (8) is rotatably mounted in bearing seats on both sides of cross beams of the forming frame (1).

Referring to FIG. 1, in certain embodiments of equipment in accordance with the present invention, each vertical transfer air cylinder (6) may be connected to its respective transfer plate apparatus (28) by way of a pin joint or the like.

Referring to FIGS. 1 and 3, in particular embodiments of equipment in accordance with the present invention, each lower horizontal air cylinder (20) may be installed on a front crossbeam of a respective pressing frame (27).

Referring to FIGS. 1, 2 and 4, in certain embodiments of equipment in accordance with the present invention, the forming hydraulic cylinder (7) may be fixed with respect to the forming frame (1) by way of, for example, a cylinder block (15) or the like.

Referring to FIG. 1, in particular embodiments of equipment in accordance with the present invention, the horizontal guide tracks (29) may be set on upper cross beams of the pressing frame (27). Further, support seats for the press support plates (24) may be fixed to respective high-temperature drying station frames.

Referring FIG. 4 for illustration, certain embodiments of equipment in accordance with the present invention may comprise two pair of high temperature drying stations (32). In such embodiments, the suction filter forming station (30) may include a respective transfer plate apparatus (28) for each pair of high-temperature drying stations (32) (such transfer plate apparatuses (28) being disposed beneath their respective transfer support plates (12) and (12') in the same manner shown in FIG. 1).

Methods for Forming Waste-Paper-Based Packaging Products

Figure 5:
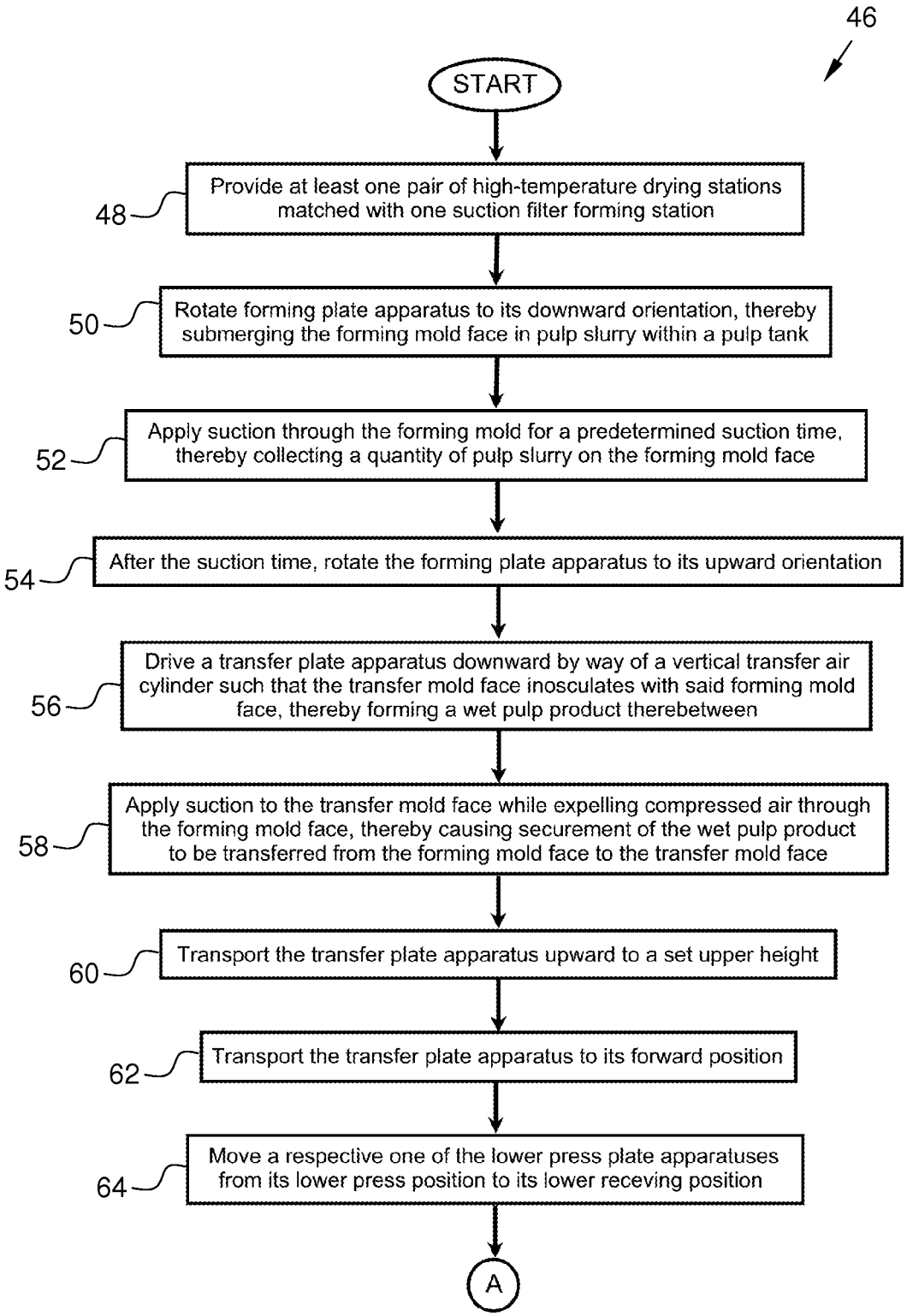
FIG. 5 is a flow diagram depicting steps of one non-limiting embodiment of a method for forming waste-paper-based packaging products.
Figure 6:
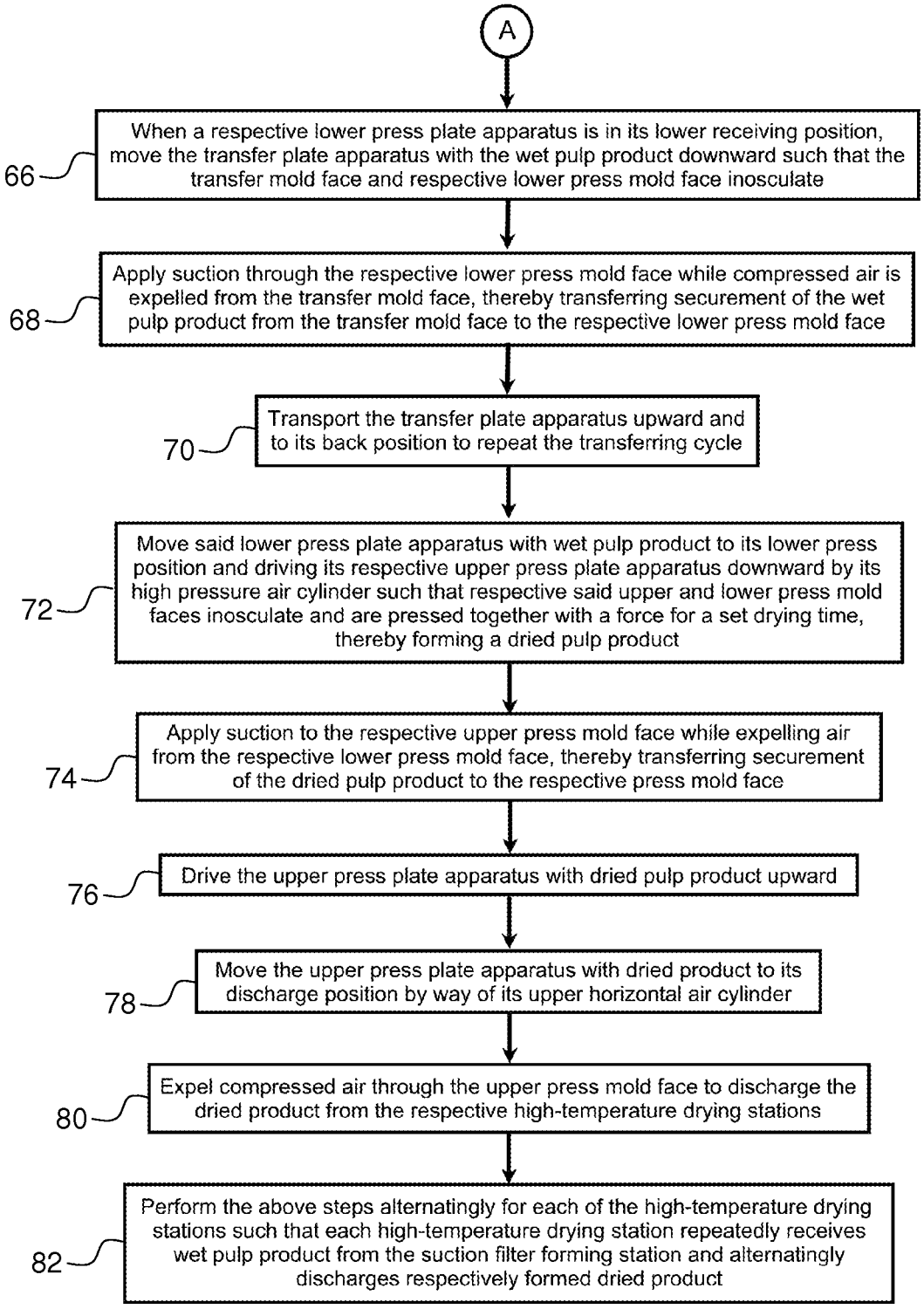
FIG. 6 is a continuation of the flow diagram of FIG. 5.

Referring to FIGS. 5 and 6, one or more non-limiting embodiments of a method of producing a molded pulp product are represented in the flow diagram depicted at (46). In certain preferred embodiments, this pulp product may be substantially comprised of waste paper. Such a method may comprise one or more of the steps represented by blocks in this diagram. Moreover, such steps may preferably, but not necessarily exclusively, be performed in the order shown.

At block (48) of FIG. 5, at least one pair of high-temperature drying stations is/are provided which are preferably matched (i.e., integrated) with one suction filter forming station (30). The suction filter forming station (30) may preferably include a forming plate apparatus (3) and at least one transfer plate apparatus (28). The forming plate apparatus (3) being fitted with a forming mold (11) having a forming mold face. Referring to FIG. 1, the forming plate apparatus (3) may be reciprocatingly rotatable between a downward orientation (the downward direction being illustrated, for example, at (36)) and an upward orientation (the upward direction being illustrated, for example, at (38)) by way of an actuator.

Each transfer plate apparatus (28) may have a transfer mold (13) face and may be transportable between a back position and a forward position. The backward direction relative to respective transfer plate apparatus (28) is depicted, for example, at (44), and the forward direction is depicted for example at (42). The back position typically directly above the forming plate apparatus (3), and the forward position is typically between the transfer plate apparatus' (28) respective pair of high-temperature drying stations (32) and directly above and center of respective lower horizontal guide tracks. In FIG. 2, the transfer plate apparatus (28), which is directly under its transfer support plate (12), is in its forward position.

Referring to FIG. 3, each one of the high-temperature drying stations (32) may preferably comprise an upper press plate apparatus (17), a lower press plate apparatus (18), a high pressure air cylinder (19), and an upper horizontal air cylinder (22). Each upper press plate apparatus (17) may have an upper press mold (23) face and may be movable between an upper press position and a discharge position. In FIGS. 2 and 4, the upper press plate apparatuses, which are directly under their respective press support plate (24), are in their respective discharge positions. Each lower press plate apparatus (18) may have a respective lower press mold (26) face and may be movable along respective lower horizontal guide tracks between a lower receiving position and a lower press position. The lower receiving position is typically directly below the forward position of the respective transfer plate apparatus (28). The lower press position is typically directly below the upper press position of the respective upper press plate apparatus (17).

Returning to FIG. 5, at block (50) the forming plate apparatus (3) may be rotated to its downward orientation, thereby submerging the forming mold (11) face in pulp slurry within a pulp tank (2). At block (52), suction may be applied through the forming mold (11) for a predetermined suction time, thereby collecting a quantity of pulp slurry on the face of the forming mold (11). At block (54), after the requisite suction time, forming plate apparatus (3) is rotated back to its upward orientation (such upward orientation being illustrated, for example, at FIGS. 1-3).

At block (56) of FIG. 5, a transfer plate apparatus (28) is driven downward by way of, for example, a vertical transfer air cylinder (6) such that the transfer mold (13) face inosculates with the forming mold (11) face, thereby forming a wet pulp product therebetween. At block (58), suction may be applied to the respective transfer mold (13) face while compressed air is expelled through the forming mold (11) face, thereby causing securement of the wet pulp product to be transferred from the forming mold face to the transfer mold face.

At block (60) of FIG. 5, the respective transfer plate apparatus (28) may be transported upward to a set upper height (see, for example, FIG. 1). At block (62), the transfer plate apparatus (28) is transported to its forward position by way of, for example, its transfer horizontal air cylinder (5) (see, for example, FIG. 2).

At block (64) of FIG. 5, a respective one of the lower press plate apparatuses (18) is moved from its lower press position to its lower receiving position, for example by moving laterally in direction (38) or (40), as appropriate. At block (66), when the respective lower press plate apparatus (18) is in its lower receiving position, the transfer plate apparatus (28) with the wet pulp product is moved downward such that the transfer mold (13) face and respective lower press mold (26) face inosculate (see, for example, FIG. 3). At block (68), suction may be applied through the respective lower press mold (26) face while compressed air is expelled from the transfer mold (13) face, thereby transferring securement of the wet pulp product from the transfer mold (13) face to the respective lower press mold (26) face. At block (70), the transfer plate apparatus (28) may be transported upward and to its back position to repeat, for example, the transferring cycle. The term "transferring cycle" may be substantially defined, for example, as the series of steps comprising or represented by blocks (56) through (62), and (66) through (70).

At block (72) of FIG. 6, respective lower press plate apparatus (18) with wet pulp product is moved to its lower press position and its respective upper press plate apparatus (17) driven downward by, for example, its high pressure air cylinder (19) such that respective upper and lower press mold faces inosculate and are pressed together with a force for a set drying time, thereby forming a dried pulp product. In particular preferred embodiments, this force may be greater than six tons. In certain preferred embodiments, this force may be approximate twelve tons. In particular embodiments, at about twelve tons of pressing force, approximately 12.5 psi would be provided over a 32"×60" molding surface area of a particular mold. Such settings may be variable depending upon the contours of the selected molds and the desired result.

At block (74) of FIG. 6, suction may be applied to the respective upper press mold (23) face while expelling air from the respective lower press mold (26) face, thereby transferring securement of the dried pulp product to the respective upper press mold face. At block (76), the upper press plate apparatus (17) with dried pulp product secured thereto is driven upward (e.g., in direction (34)). At block (78), the upper press plate apparatus (17) with its dried product is moved to its discharge position by way of, for example, its upper horizontal air cylinder (22). At block (80), compressed air may be expelled through the upper press mold (23) face to discharge the respective instance of dried product from the respective high-temperature drying station (32). As illustrated in FIG. 3, for example, a product support platform (52) may be used for supporting one or more growing stacks of dried product (50) received from the upper press plate apparatus (17) of the respective high-temperature drying station (32).

As provided at block (82) of FIG. 6, in preferred embodiments of the methods described herein, the respective steps are performed for each of the high-temperature drying stations (32) in alternating fashion such that each high-temperature drying station (32) repeatedly receives wet pulp product from the suction filter forming station (30) and alternatingly discharges respectively formed dried product.

In certain preferred embodiments of the methods described herein, the lower press plate apparatuses of each at least one pair of high-temperature drying stations are moved alternatingly from their respective lower press position to their lower receiving position by way of a respective lower horizontal air cylinder (20). Such movement is generally in lateral directions (38) and (40) shown in FIGS. 2 and 4.

In particular embodiments of the methods described herein the actuator is a forming hydraulic cylinder (7). Moreover, a bottom of the forming plate apparatus (3) may be connected to an upper side of a forming apparatus main shaft (8) and rotatable therewith. The forming apparatus main shaft (8) may be equipped with a toothed gear (10). One end of the forming hydraulic cylinder (7) may be fixed with respect to a forming frame (1), and an opposing end of the forming hydraulic cylinder (7) may be connected with a toothed rack (16) which meets with the toothed gear (10). The forming hydraulic cylinder (7) may be configured to linearly actuate the toothed rack (16) in engagement with the toothed gear (10) so as to cause the forming apparatus main shaft (8) to facilitate the steps of rotating represented, for example, at blocks (50) and (54) of FIG. 5.

As illustrated for example in FIG. 4, in certain embodiments of the methods described herein, the step of providing (48) provides two pair of high-temperature drying stations (32) matched with one suction filter forming station (30). In such embodiments, the suction filter forming station (30) preferably includes a respective transfer plate apparatus (28) for each pair of high-temperature drying stations (32).

In preferred embodiments comprising four high-temperature drying stations (such as the embodiment shown in FIG. 4) the two transfer plate apparatuses alternate to transfer wet product from the forming plate apparatus, each transfer plate apparatus transfers wet product to a respective side. Corresponding reference characters on the second side include prime symbol. For example, the second pair of high-temperature drying stations are indicated at (32'). Moreover, "forward" and "backward" movement of the two transfer support plates (and their respective transfer support apparatuses) are defined by how they are moving with respect to the single suction filter forming station (30). Thus, forward movement of the transfer support plate (21) would be in the (42) direction, while forward movement of the transfer support plate (21') would be in the opposite (42') direction. The two pairs of high temperature drying stations each perform the same corresponding movements to receive product from their respective transfer plate apparatus but alternate to receive wet product from the suction filter forming station. All four stations alternate to maximize the relatively high production rate of the suction filter forming station.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for forming waste-paper-based packaging products, said method comprising the steps of:

providing at least one pair of high-temperature drying stations matched with one suction filter forming station, said suction filter forming station including a forming plate apparatus and at least one transfer plate apparatus, said forming plate apparatus being fitted with a forming mold having a forming mold face, said forming plate apparatus being reciprocatingly rotatable between a downward orientation and an upward orientation by way of an actuator, each said at least one transfer plate apparatus having a transfer mold face and being transportable between a respective back position and forward position, said back position being directly above said forming plate apparatus, said forward position being between its respective said pair of high-temperature drying stations and directly above and center of respective lower horizontal guide tracks, each one of said high-temperature drying stations comprising an upper press plate apparatus, a lower press plate apparatus, a high pressure air cylinder, and an upper horizontal air cylinder, each upper press plate apparatus having an upper press mold face and being movable between an upper press position and a discharge position, each lower press plate apparatus having a respective lower press mold face and being movable along respective said lower horizontal guide tracks between a lower receiving position and a lower press position, said lower receiving position being directly below said forward position of the respective said transfer plate apparatus, said lower press position being directly below said upper press position of the respective said upper press plate apparatus;

rotating said forming plate apparatus to its downward orientation, thereby submerging said forming mold face in pulp slurry within a pulp tank;

applying suction through said forming mold for a predetermined suction time, thereby collecting a quantity of said pulp slurry on said forming mold face;

after said suction time, rotating said forming plate apparatus to its upward orientation;

driving a respective said transfer plate apparatus downward by way of a vertical transfer air cylinder such that said transfer mold face inosculates with said forming mold face, thereby forming a wet pulp product therebetween;

applying suction to said transfer mold face while expelling compressed air through said forming mold face, thereby causing securement of said wet pulp product to be transferred from said forming mold face to said transfer mold face;

transporting said transfer plate apparatus upward to a set upper height;

transporting said transfer plate apparatus to its forward position by way of its transfer horizontal air cylinder;

moving a respective one of said lower press plate apparatuses from its lower press position to its lower receiving position;

when the respective said lower press plate apparatus is in its said lower receiving position, moving said transfer plate apparatus with said wet pulp product downward such that said transfer mold face and respective lower press mold face inosculate;

applying suction through said respective lower press mold face while compressed air is expelled from said transfer mold face, thereby transferring securement of said wet pulp product from said transfer mold face to the said respective lower press mold face;

transporting said transfer plate apparatus upward and to its back position to repeat the transferring cycle;

moving said respective lower press plate apparatus with wet pulp product to its lower press position and driving its respective upper press plate apparatus downward by its high pressure air cylinder such that respective said upper and lower press mold faces inosculate and are pressed together with a force for a set drying time, thereby forming a dried pulp product;

applying suction to respective said upper press mold face while expelling air from respective said lower press mold face, thereby transferring securement of said dried pulp product to respective said upper press mold face;

driving said upper press plate apparatus with said dried pulp product upward;

moving said upper press plate apparatus with said dried product to its discharge position by way of its upper horizontal air cylinder; and expelling compressed air through said upper press mold face to discharge said dried product from respective said high-temperature drying station.

2. A method as defined in claim 1 wherein said steps are performed for each of said high-temperature drying stations in alternating fashion such that each said high-temperature drying station repeatedly receives wet pulp product from the suction filter forming station and alternatingly discharges respectively formed dried product.

3. A method as defined in claim 2 wherein said lower press plate apparatuses of each said at least one pair are moved alternatingly from their lower press position to their lower receiving position by way of a respective lower horizontal air cylinder.

4. A method as defined in claim 1 wherein said forming apparatus main shaft is rotatably mounted in bearing seats cross beams of said forming frame.

5. A method as defined in claim 1 wherein:

said actuator being a forming hydraulic cylinder;

a bottom of said forming plate apparatus is connected to an upper side of a forming apparatus main shaft and rotatable therewith, said forming apparatus main shaft being equipped with a toothed gear;

one end of said forming hydraulic cylinder is fixed with respect to a forming frame, an opposing end of said forming hydraulic cylinder being connected with a toothed rack which meets with said toothed gear; and said forming hydraulic cylinder is configured to linearly actuate said toothed rack in engagement with said toothed gear so as to cause said forming apparatus main shaft to facilitate said steps of rotating.

6. A method as defined in claim 1 wherein:

the step of providing provides two pair of high-temperature drying stations matched with said one suction filter forming station; and said suction filter forming station includes a respective said transfer plate apparatus for each said pair of high-temperature drying stations.

7. A method as defined in claim 1 wherein said force is greater than six tons.

8. A method as defined in claim 1 wherein said pulp product is substantially comprised of waste paper.

* * * * *